US007467979B2

(12) United States Patent
Colescott et al.

(10) Patent No.: US 7,467,979 B2
(45) Date of Patent: Dec. 23, 2008

(54) APPARATUS AND METHOD FOR ELECTRICAL AND MECHANICAL CONNECTION

(75) Inventors: Michael G. Colescott, Galveston, TX (US); Wayne Horley, Sherwood Park (CA); Jeffrey W. Harvill, Sr., Keithville, LA (US); Roy Jackson, Houston, TX (US)

(73) Assignee: Power Feed-Thru Systems & Connectors, LLC, Deer Park, TX (US)

( * ) Notice: Subject to any disclaimer, the term of this patent is extended or adjusted under 35 U.S.C. 154(b) by 18 days.

(21) Appl. No.: 11/458,939

(22) Filed: Jul. 20, 2006

(65) Prior Publication Data

US 2007/0287323 A1 Dec. 13, 2007

Related U.S. Application Data

(60) Provisional application No. 60/812,887, filed on Jun. 12, 2006.

(51) Int. Cl.
*H01R 4/38* (2006.01)
*H01R 11/09* (2006.01)

(52) U.S. Cl. ..... 439/784; 439/805

(58) Field of Classification Search ..... 439/877, 439/784, 805, 462, 810, 812, 585, 428, 429, 439/439

See application file for complete search history.

(56) References Cited

U.S. PATENT DOCUMENTS 902,235 A * 10/1908 Kellner ..... 439/805
1,342,819 A * 6/1920 Lake ..... 439/805
2,056,248 A * 10/1936 Buchanan ..... 439/784
2,209,620 A * 7/1940 Berndt et al. ..... 439/820
2,279,508 A * 4/1942 Bergan ..... 439/805
2,753,541 A * 7/1956 Leonard ..... 439/805
3,824,556 A * 7/1974 Berkovits et al. ..... 439/727
3,846,738 A * 11/1974 Nepovim ..... 439/584
3,945,700 A 3/1976 Didier
4,728,296 A * 3/1988 Stamm ..... 439/275
4,927,386 A 5/1990 Neuroth
4,944,699 A * 7/1990 Velke, Sr. et al. ..... 439/784
5,100,348 A * 3/1992 Herman et al. ..... 439/805
5,362,253 A * 11/1994 Lin et al. ..... 439/462
5,458,507 A 10/1995 Colescott et al.
5,474,478 A * 12/1995 Ballog ..... 439/805
5,490,803 A * 2/1996 McMills et al. ..... 439/936
5,573,423 A * 11/1996 Lin et al. ..... 439/462
5,868,554 A * 2/1999 Giacomino et al. ..... 417/56
5,975,939 A * 11/1999 Market ..... 439/415
6,341,979 B1 * 1/2002 Yamamoto ..... 439/415

* cited by examiner

*Primary Examiner*—Briggitte R Hammond

(57) ABSTRACT

An apparatus for engaging an electrical conductor comprises a gripping contact having a plurality of fingers, where the plurality of fingers has a substantially conical outer surface. A contact receptacle has a substantially conical inner surface. A tension member urges the gripping contact toward the contact receptacle such that interaction between the substantially conical outer surface and the substantially conical inner surface forces the plurality of fingers to engagingly compress the electrical conductor placed between the fingers. A method of engaging an electrical conductor comprises inserting an electrical conductor between a plurality of fingers of a gripping contact, where the plurality of fingers has a substantially conical outer surface. The substantially conical outer surface of the gripping contact is urged to interact with a substantially conical inner surface of a contact receptacle such that the interaction forces the plurality of fingers to engage the electrical conductor.

18 Claims, 4 Drawing Sheets

Section A-A

APPARATUS AND METHOD FOR ELECTRICAL AND MECHANICAL CONNECTION

CROSS-REFERENCE TO RELATED APPLICATIONS

This application claims priority from U.S. Provisional Application 60/812,887 filed on Jun. 12, 2006.

BACKGROUND

1. Field of the Invention

The present invention relates to the field of electrical connectors.

2. Background Information

Numerous applications involve the use of electrical connectors. High power connectors are used in applications including subsea connections, and in submersible pump connections in both water wells and oil wells. The size, weight, and orientation of the cables and connectors induce mechanical loads on connector components that make reliable mechanical and electrical connection difficult. In addition, the physical environment may include high temperature, high pressure, and abrasive and/or corrosive liquids and gases.

SUMMARY

In one aspect of the present invention, an apparatus for engaging an electrical conductor comprises a gripping contact having a plurality of fingers, where the plurality of fingers has a substantially conical outer surface. A contact receptacle has a substantially conical inner surface. A tension member urges the gripping contact toward the contact receptacle such that interaction between the substantially conical outer surface and the substantially conical inner surface forces the plurality of fingers to engagingly compress the electrical conductor placed between the fingers.

In another aspect, a method of engaging an electrical conductor comprises inserting an electrical conductor between a plurality of fingers of a gripping contact, where the plurality of fingers has a substantially conical outer surface. The substantially conical outer surface of the gripping contact is urged to interact with a substantially conical inner surface of a contact receptacle such that the interaction forces the plurality of fingers to engage the electrical conductor.

In yet another aspect, an apparatus comprises a submersible pump in a wellbore. A cable having an electrical conductor is in electrical communication with the submersible pump. A gripping contact assembly engages the electrical conductor and facilitates the transmission of electrical power to the submersible pump.

Non-limiting examples of certain aspects of the invention have been summarized here rather broadly in order that the detailed description thereof that follows may be better understood, and in order that the contributions they represent to the art may be appreciated. There are, of course, additional features of the invention that will be described hereinafter.

BRIEF DESCRIPTION OF THE FIGURES

For a detailed understanding of the present invention, references should be made to the following detailed description of the exemplary embodiment, taken in conjunction with the accompanying drawings, in which like elements have been given like numerals, wherein.

DETAILED DESCRIPTION

Figure 1:
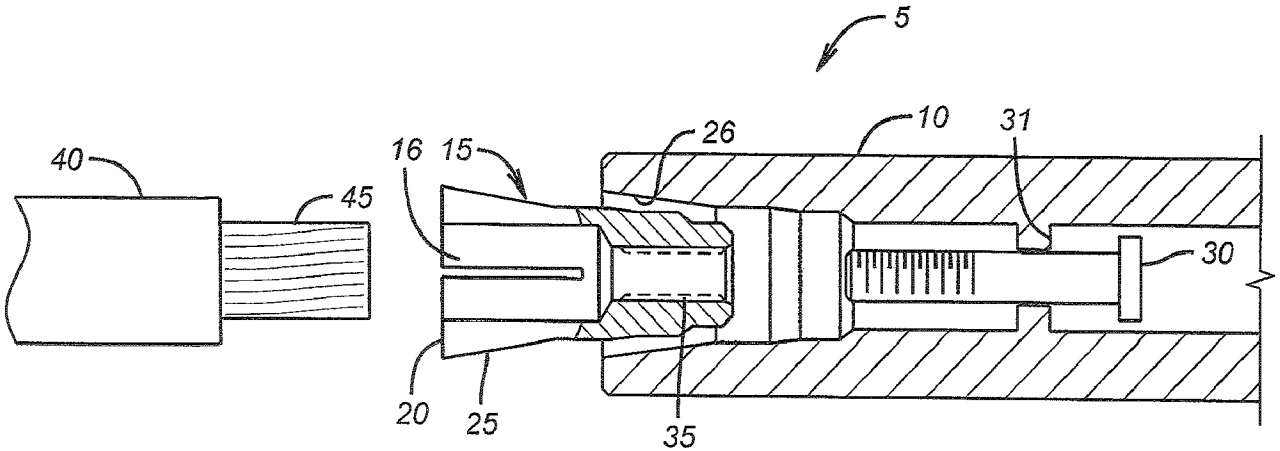
FIG. 1 shows an exploded view of a connector contact assembly according to one illustrative embodiment of the present invention.

The following description presents non-limiting examples of embodiments of the present invention. Refer now to FIGS. 1-4B. FIG. 1 shows an exploded view of a connector contact assembly 5 according to one illustrative embodiment of the present invention. As shown in FIG. 1, a cable 40 has an electrical conductor 45 therein. Electrical conductor 45 may be a solid conductor, or, alternatively, a stranded conductor.

A gripping contact 15 has a cavity 16 sized to accept electrical conductor 45. In one embodiment, the inner diameter of cavity 16 is a substantially a zero clearance fit with the outer diameter of electrical conductor 45. Gripping contact 15 (see also FIGS. 4A and 4B) comprises a plurality of gripping fingers 20 with an outer surface 25 having a substantially conical shape. As seen, in FIG. 4B, the conical surface 25 is defined by angle $\beta$. In one embodiment, angle $\beta$ is about 6°. Alternatively, angle $\beta$ may be in the range of about 2° to about 10°. The internal surface 21 of fingers 20 substantially defines cavity 16. While shown in FIG. 4A as comprising four fingers, any number of fingers may be used and are intended to be encompassed by the present disclosure. In one embodiment, the internal surface 21 of fingers 20 may be substantially smooth. Alternatively, in another embodiment, the internal surface 21 of fingers 20 may have a raised pattern (not shown) formed on surface 21. Such a pattern may include, but is not limited to: a thread form, a tooth form, a knurling form, and any other raised pattern form used for gripping electrical conductor 45.

On an opposite end of gripping contact 15, an integral body 27 has an internally threaded bore 35. Gripping contact 15 may be made out of an electrically conductive metal. Examples of such an electrically conductive metal include, but are not limited to: gold, silver, copper, copper alloys, aluminum, aluminum alloys, brass, bronze, and any other suitable electrically conducting metal. The surfaces 25 and 21 of fingers 20 may be plated with a suitable electrically conductive material to reduce galling and/or wear of the gripping fingers 20. Any suitable plating may be used including, but not limited to: chrome plating, nickel plating, gold plating, and silver plating.

Figure 2:
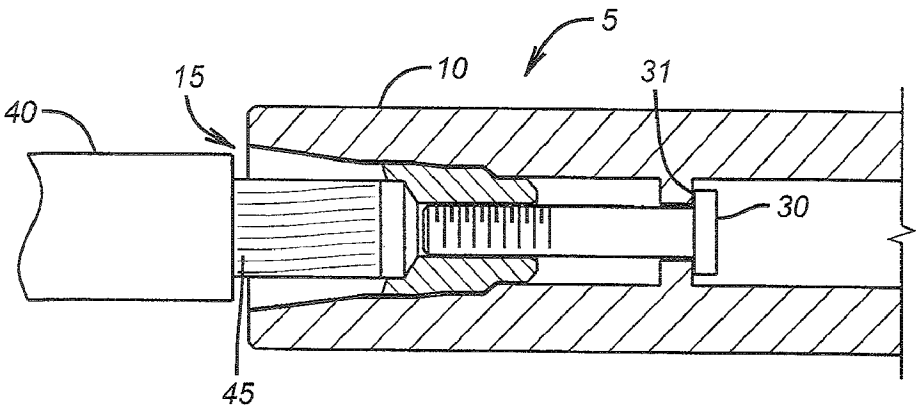
FIG. 2 shows an assembled view of the elements of FIG. 1.
Figure 3:
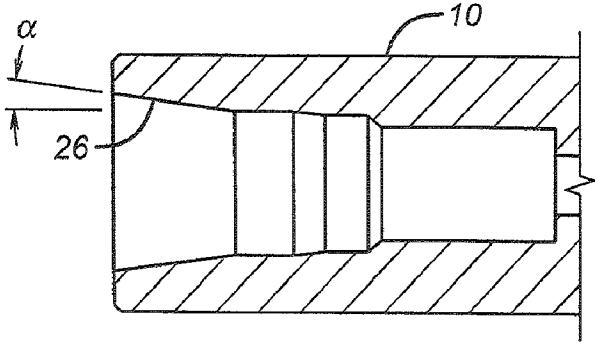
FIG. 3 shows a portion of a contact receptacle according to one illustrative embodiment of the present invention.
Figure 4B:
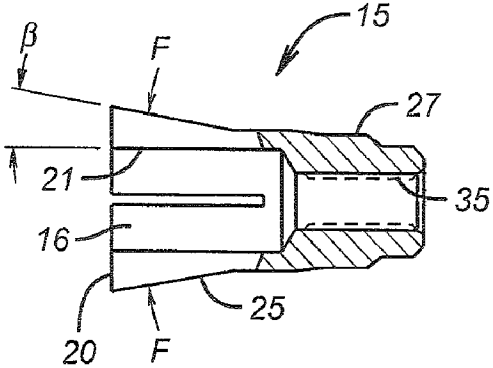
FIG. 4B shows a cross-section view along section line A-A of FIG. 4A.
Figure 4A:
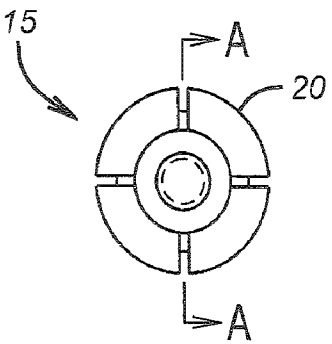
FIG. 4A shows an end view of a gripping contact according to one illustrative embodiment of the present invention.

A contact receptacle 10 (see FIGS. 1-3), has an internal conical surface 26 having an angle $\alpha$ where $\alpha \leqq \beta$. In one embodiment, $\alpha$ is on the order of 1.0° smaller than $\beta$. Alternatively, $\alpha$ may be smaller than $\beta$ from about 0.5° to about 1.5°. The difference in angles ensures that fingers 20 of gripping contact 15 are forced to collapse around and compress electrical conductor 45, as shown in FIGS. 1 and 2, when gripping contact 15 is urged axially into contact receptacle 10. Contact receptacle 10 may be made from any of the materials as described previously for gripping contact 15. Similarly, contact receptacle 10 may be plated by any of the platings discussed previously with respect to gripping contact 15.

As shown in FIGS. 1 and 2, threaded element 30 engages threads 35 in gripping contact 15 and, under tension, reacts against shoulder 31 in contact receptacle 10 such that gripping contact 15 is axially urged into contact receptacle 10. This motion causes interaction between outer surface 25 and inner surface 26 such that fingers 20 of gripping contact 15 are forced to collapse around and compress electrical conductor 45 along substantially the length of the extension of electrical conductor 45 into gripping contact 15. The use of threaded element 30 provides a substantially repeatable force urging gripping contact 15 into contact receptacle 10, thereby providing a repeatable holding force between electrical contact 45 and connector contact assembly. In addition, the substantially repeatable axial holding force provides a repeatable electrical contact between fingers 20 of gripping contact 15 and both electrical conductor 45 and contact receptacle 10. Threaded element 30 may be a suitably sized threaded fastener that may be commercially available. Alternatively, threaded element 30 may be designed for this particular application using techniques known in the art.

Figure 5:
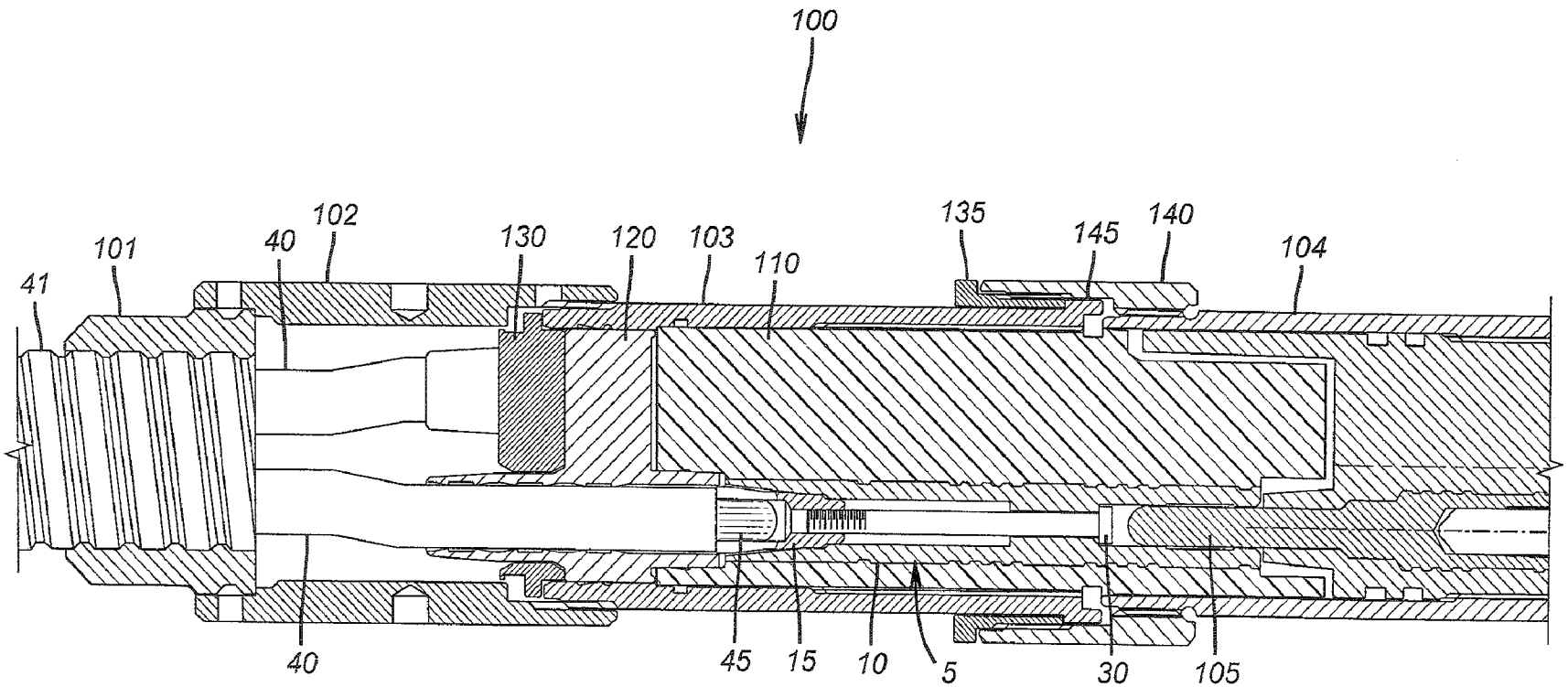
FIG. 5 shows a non-limiting example of a portion of a connector assembly according to one illustrative embodiment of the present invention.

FIG. 5 depicts a non-limiting example of a portion of a connector assembly 100 according to one illustrative embodiment of the present invention. Connector assembly 100 may be a power connector for use in connecting a power source to a submersible pump in a well. Alternatively, connector assembly 100 may be a sub-sea connector. As shown in FIG. 5, a multi-conductor armored cable assembly 41 has at least one insulated cable 40 with an internal electrical conductor 45. Armored cable assembly 41 is connected to connector assembly 100 by cable adapter 101. Crossover 102 connects cable adapter 101 to lower housing 103.

It will be appreciated by one skilled in the art that the portion of connector assembly 100 shown in FIG. 5 may be immersed in a high pressure fluid such as, for example, in a wellbore. To seal high pressure fluid from the internal electrical connections, cable 40 is inserted through seal 120. Seal 120 is an elastomer seal that is compressed around the insulation of cable 40 to preclude passage of fluid toward the electrical contacts 15 and 10. Seal 120 is held in place by follower 130. Seal 120 may be made of a suitable elastomer. Suitable elastomers include but are not limited to, natural rubber, synthetic rubber, fluoroelastomers, perfluoroelastomers, ethylene propylene diene rubber, and any other suitable elastomer.

Connector contact assembly 5 is inserted into an insulator 110 that is located above seal 120. As shown, connector contact assembly 5 comprises gripping contact 15 assembled in contact receptacle 10 and held in place by threaded element 30. To better facilitate field assembly, insulator 110 is located in lower housing 103 and upper housing 104 that are connected through coupling nut 140 and shoulder nut 135 acting against shoulder 145. Insulator 110 may be a thermoplastic suitable for the particular environment encountered. Examples of such a thermoplastic include, but are not limited to, a polyetheretherketone material and a glass-filled polyetheretherketone material. Gripping contact 15 is in engaged contact, both mechanically and electrically with electrical conductor 45. Connector assembly 5 conducts an electrical power signal to contact 105 which is electrically conducted to a surface power control system. One skilled in the art will appreciate that the connector assembly 5 and its components may be appropriately scaled to fit different size electrical conductors without undue experimentation.

Figure 6:
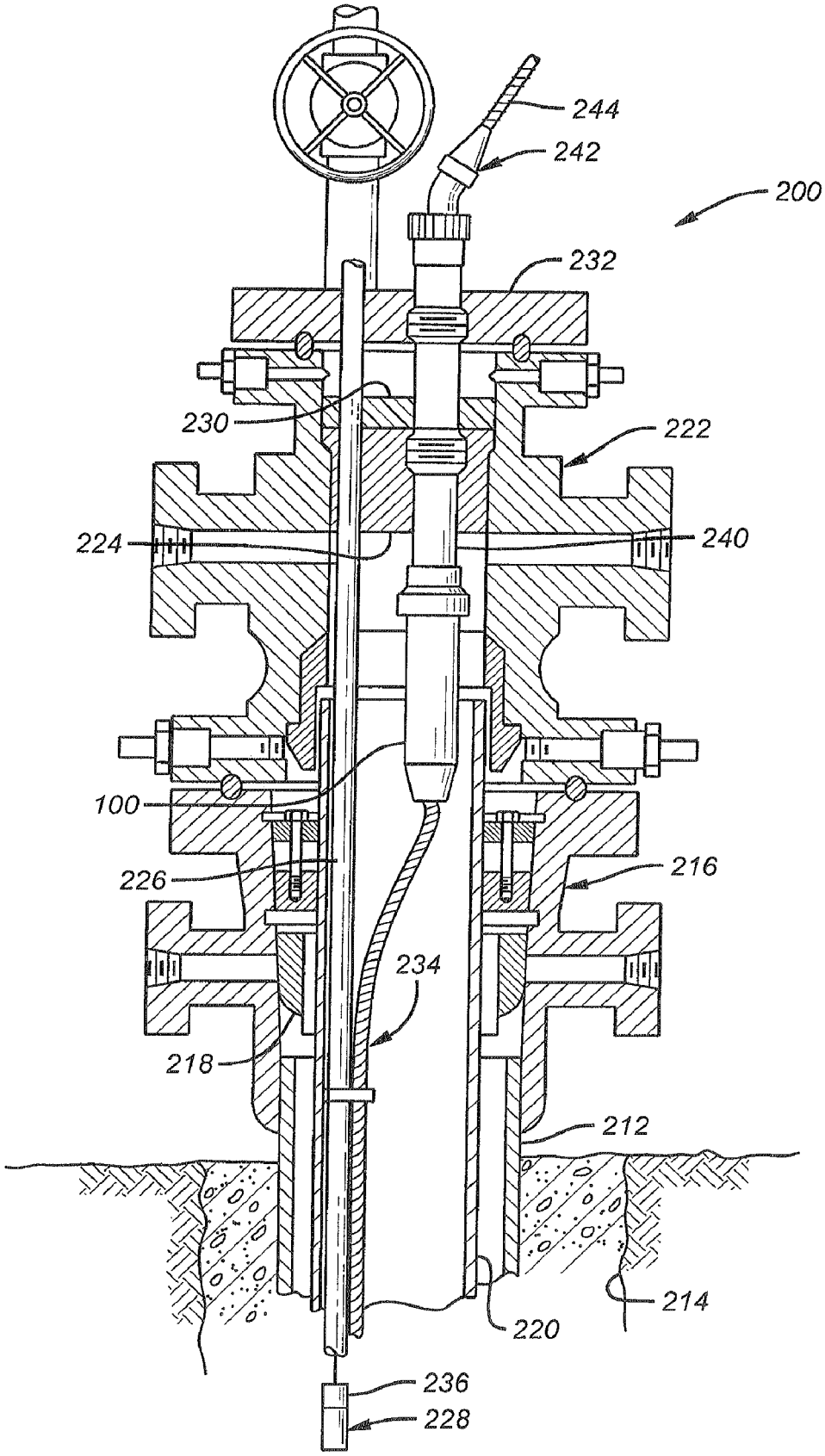
FIG. 6 shows a non-limiting example of a connector utilizing a contact assembly of one embodiment of the present invention to connect power to a submersible pump.

One non-limiting example of an application of the present invention is shown in FIG. 6. In FIG. 6, a well 200 comprises a string of surface pipe 212 cemented in the upper portion of a bore hole 214 which extends into the earth to a location adjacent and usually below a subterranean oil productive formation (not shown). A wellhead 216 attaches to the surface pipe 212. A set of slips 218 suspends a casing string 220 inside the bore hole 214 which is also cemented in place. A casing head 222 connects to the upper end of the casing string 220 and includes a tubing hanger 224.

A tubing string 226 is suspended from the tubing hanger 224 and extends downwardly inside the casing string 220 to a location adjacent the productive formation. An electrically powered submersible pump 228, of any suitable type, on the lower end of the tubing string 226 pumps oil or an oil-water mixture from the inside of the casing string 220 upwardly through the tubing string 226.

Electric power is delivered to the downhole pump 228 through an armored cable 234 connected to a motor 236 comprising part of the submersible pump 228. The cable 234 extends upwardly in the well 210 to a connector 100 of the present invention located immediately below the tubing hanger 224. The connector 100 is secured to a mandrel or feed through socket 240 extending through the hanger 224, seal assembly 230 and flange 232. The connector 100 employs a contact assembly as described previously. In one embodiment, a pig tail connector 242 attaches the mandrel 240 to a power cable 244 extending to a source of power at the surface.

While described above as used in a submersible pump application, it is intended that the present invention encompass all applications requiring high electrical power transmission. Such applications include, but are not limited to: electrical motor connectors, transformer connectors, electrical generator connectors, welding machine connectors, and any other such electrical and/or electromagnetic devices.

While the foregoing disclosure is directed to the non-limiting embodiments of the invention, various modifications will be apparent to those skilled in the art. It is intended that all variations within the scope of the appended claims be embraced by the foregoing disclosure.

What is claimed is:

1. An apparatus for engaging an electrical conductor, comprising:

a gripping contact having a plurality of fingers, the plurality of fingers having a substantially conical outer surface;

a contact receptacle having a substantially conical inner surface; and a threaded tension member threadedly engaging the gripping contact and pulling the gripping contact into the contact receptacle such that interaction between the substantially conical outer surface and the substantially conical inner surface forces the plurality of fingers to engagingly compress the electrical conductor placed between the fingers.

2. The apparatus of claim 1, wherein the substantially conical outer surface comprises a first angle of about 6 degrees.

3. The apparatus of claim 1, wherein the substantially conical outer surface comprises a first angle in the range of about 2 degrees to about 10 degrees.

4. The apparatus of claim 1, wherein the substantially conical inner surface comprises a second angle that is substantially the same as the first angle.

5. The apparatus of claim 1, wherein the substantially conical inner surface comprises a second angle that is less than the first angle by about 0.5 degree to about 1.5 degrees.

6. The apparatus of claim 1, wherein the threaded tension member comprises a threaded fastener.

7. The apparatus of claim 1, wherein the contact receptacle is made from an electrically conductive metal.

8. The apparatus of claim 1, wherein the gripping contact is made from an electrically conductive metal.

9. The apparatus of claim 8, wherein the electrically conductive metal is chosen from the group consisting of: gold, silver, copper, copper alloys, aluminum, aluminum alloys, brass, and bronze.

10. The apparatus of claim 8, wherein the electrically conductive metal is chosen from the group consisting of: gold, silver, copper, copper alloys, aluminum, aluminum alloys, brass, and bronze.

11. A method of engaging an electrical conductor, comprising:

inserting an electrical conductor between a plurality of fingers of a gripping contact, the plurality of fingers having a substantially conical outer surface; and actuating a threaded tension member threadedly engaging the gripping contact such that the tension member pulls the gripping contact into a contact receptacle and forcing the substantially conical outer surface of the gripping contact to interact with a substantially conical inner surface of the contact receptacle such that the interaction forces the plurality of fingers to engage the electrical conductor.

12. The method of claim 11, wherein the substantially conical outer surface comprises a first angle of about 6 degrees.

13. The method of claim 11, wherein the substantially conical outer surface comprises a first angle in the range of about 2 degrees to about 10 degrees.

14. The method of claim 11, wherein the substantially conical inner surface comprises a second angle that is substantially the same as the first angle.

15. The method of claim 11, wherein the substantially conical inner surface comprises a second angle that is less than the first angle by about 0.5 degree to about 1.5 degrees.

16. An apparatus comprising:

a submersible pump in a wellbore;

a cable having an electrical conductor in electrical communication with the submersible pump;

a gripping contact assembly engaging the electrical conductor and facilitating the transmission of electrical power to the submersible pump wherein the gripping contact assembly comprises:

a gripping contact having a plurality of fingers, the plurality of fingers having a substantially conical outer surface;

a contact receptacle having a substantially conical inner surface; and a threaded tension member threadedly engaging the gripping contact and pulling the gripping contact into the contact receptacle such that interaction between the substantially conical outer surface and the substantially conical inner surface forces the plurality of fingers to engagingly compress the electrical conductor placed between the fingers.

17. The apparatus of claim 16, wherein the substantially conical outer surface comprises a first angle in the range of about 2 degrees to about 10 degrees.

18. The apparatus of claim 16, wherein the substantially conical inner surface comprises a second angle that is less than the first angle by about 0.5 degree to about 1.5 degrees.

* * * * *